United States Patent [19]

Kirby, Jr.

[11] 4,023,491

[45] May 17, 1977

[54] INK FOUNTAIN AND SUPPLY SYSTEM FOR A PRINTING PRESS

[75] Inventor: Raymond L. Kirby, Jr., Vandalia, Ohio

[73] Assignee: Monarch Marking Systems, Inc., Dayton, Ohio

[22] Filed: Mar. 10, 1975

[21] Appl. No.: 556,738

Related U.S. Application Data

[62] Division of Ser. No. 411,283, Oct. 31, 1973, Pat. No. 3,901,150.

[52] U.S. Cl. ..... 101/366; 222/385

[51] Int. Cl.[2] ..... B41F 31/08; B67D 5/46

[58] Field of Search ..... 101/350, 366, 351, 363, 101/367; 222/321, 385; 417/554

[56] References Cited

UNITED STATES PATENTS

| | | | |
|---|---|---|---|
| 1,908,707 | 5/1933 | Kramer | 222/385 |
| 2,187,084 | 1/1940 | Fox et al. | 222/385 |
| 2,253,122 | 8/1941 | Hamant | 101/366 |
| 2,410,692 | 11/1946 | Strobell | 222/321 X |
| 2,444,656 | 7/1948 | Lamatsch | 101/350 |
| 2,545,988 | 3/1951 | Bobrick | 222/385 X |
| 2,595,118 | 4/1952 | Anderson | 222/385 X |
| 2,813,485 | 11/1957 | Harless | 101/366 |
| 2,891,471 | 6/1959 | Sengewald | 101/350 X |
| 3,103,299 | 9/1963 | Werft | 222/385 X |
| 3,161,329 | 12/1964 | Fedit et al. | 222/321 |
| 3,187,960 | 6/1965 | Gorman | 222/321 |
| 3,288,061 | 11/1966 | Doyle | 101/350 X |
| 3,291,033 | 12/1966 | Curtis et al. | 222/385 X |
| 3,384,013 | 5/1968 | King et al. | 101/366 X |
| 3,458,090 | 7/1969 | Scoggin, Jr. | 222/385 X |
| 3,583,605 | 6/1971 | Corsette | 222/321 |
| 3,739,721 | 6/1973 | Miarkowaki et al. | 101/366 |
| 3,742,851 | 7/1973 | Hamisch, Sr. | 101/295 |
| 3,774,849 | 11/1973 | Boris | 222/385 X |
| 3,952,652 | 4/1976 | Hamisch, Jr. | 101/297 X |

*Primary Examiner*—Edgar S. Burr
*Assistant Examiner*—Paul J. Hirsch
*Attorney, Agent, or Firm*—Jacox & Meckstroth

[57] ABSTRACT

A printing plate is mounted on a driven print cylinder, and ink is applied to the face of the plate by an ink applying roll which forms a nip with an ink distributing roll positioned below and horizontally offset from the ink applying roll. The rolls are driven in timed relation by a set of connecting gears and are adjustable as a unit independently on opposite ends for selecting precision uniform contact of the ink applying roll with the printing plate. In addition, the ink distributing roll is adjustable on opposite ends independently relative to the ink applying roll for precisely adjusting the nip between the rolls without changing the drive relationship. The ink is supplied to the rolls by an ink recirculating pump actuated by a cam driven by the same motor which drives the print cylinder, the ink rolls and an optional web cut-off unit. The ink recirculating pump includes a reciprocating plunger-type ink supply tube disposed concentrically within an ink return tube, and the concentric tubes depend from a manifold and cap assembly into an ink supply container. A set of molded plastic check valve bodies snap-fit onto the lower end portions of the concentric tubes, and reciprocation of the inner valve body within the outer valve body produces a flow of ink upwardly through the ink supply tube while excess ink returns between the inner and outer tubes.

7 Claims, 10 Drawing Figures

FIG-1
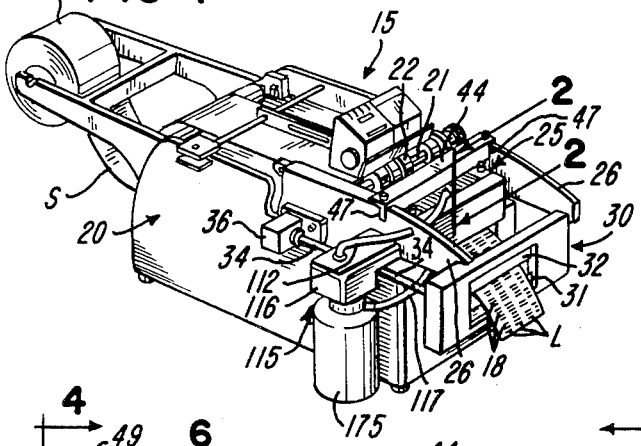
FIG-2
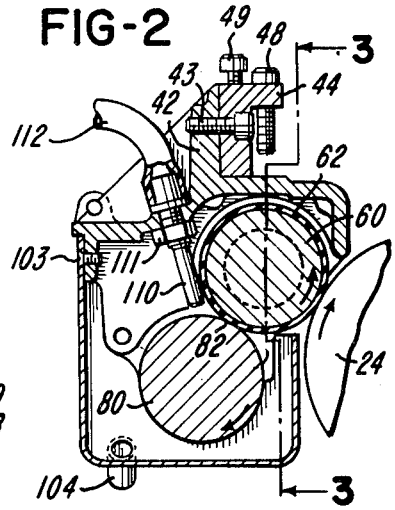
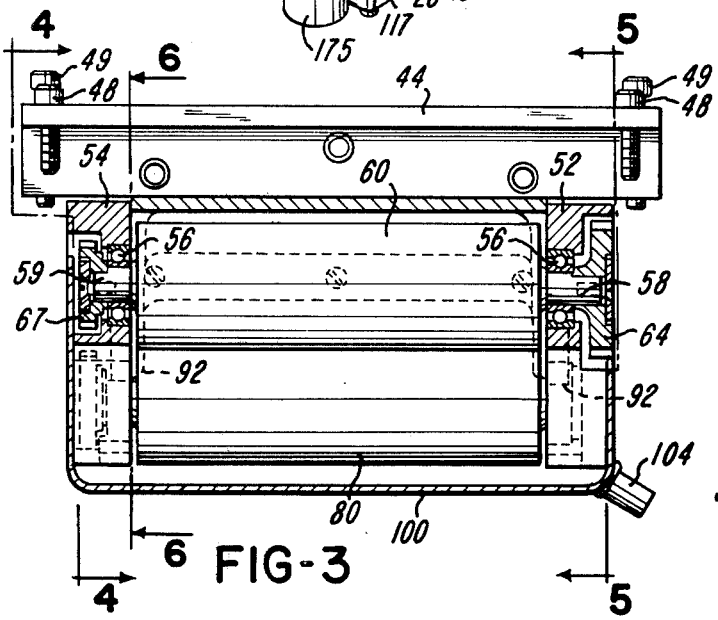
FIG-3
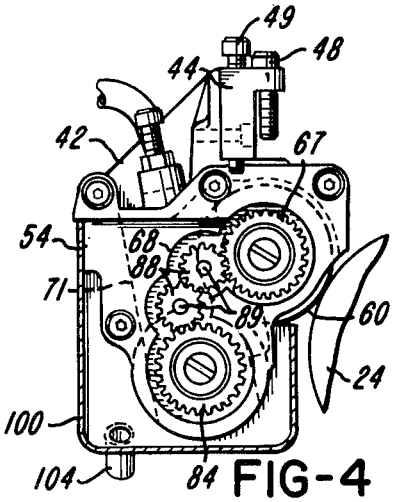
FIG-4
FIG-5
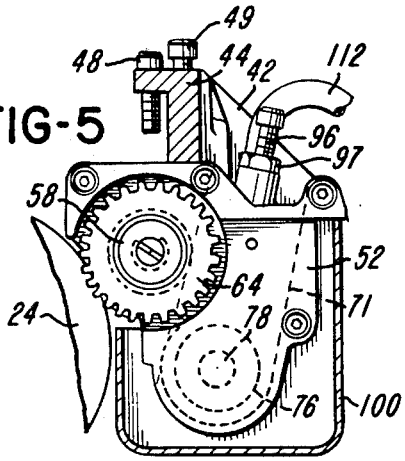
FIG-6
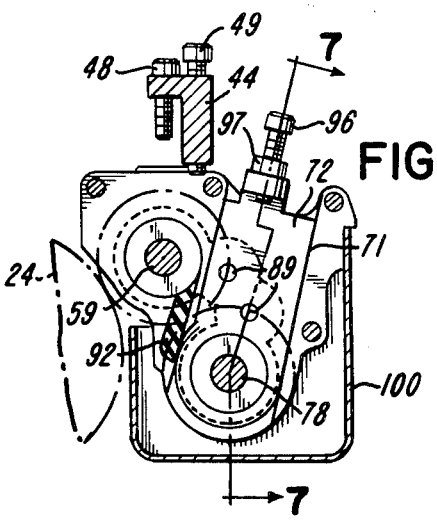

INK FOUNTAIN AND SUPPLY SYSTEM FOR A PRINTING PRESS

This is a division of application Ser. No. 411,283, filed Oct. 31, 1973 now U.S. Pat. No. 3,901,150

BACKGROUND OF THE INVENTION

In equipment or presses for printing articles such as a continuous supply of tickets, tags and labels, for example, as disclosed in U.S. Pat. No. 3,742,851 which issued to the assignee of the present invention, it has been found highly desirable to provide for precisely controlling the application of ink to the face of the printing plate mounted on the print cylinder so that precision lines or art work may be printed on the articles. For example, in recent years, a system has been developed for optically reading coded information printed on labels adapted to be attached to various products. Preferably, the machine readable coded information consists of a series of closely spaced parallel bars some of which are wide and the others of which are narrow. These bars must be precisely printed at a high speed, requiring a precise control over the amount of ink which is applied to the raised printing face of the printing plate. It is also important to supply the ink applying roll with a continuous supply of ink and to provide for recirculating the overflow or excess ink to the ink supply reservoir or container.

Various systems and mechanisms have been proposed or used for adjusting the position of an ink applying roll relative to a print cylinder which carries a printing plate. For example, U.S. Pat. No. 2,703,525 and No. 3,645,202 disclose two different types of such mechanisms. Furthermore, various systems and mechanisms have been proposed or used for supplying ink to the ink applying roll of a printing press and for returning excess or overflow ink to the ink supply reservoir or container. For example, U.S. Pat. No. 2,253,122, No. 2,869,460 and above patent No. 3,742,851 disclose different types of ink recirculating systems.

SUMMARY OF THE INVENTION

The present invention is directed to an improved system for applying ink to the face of a printing plate on a printing machine and which provides, as one important feature, an improved means for precisely controlling the amount of ink which is applied to the printing plate. In addition, the present invention provides an improved system for recirculating ink to the ink applying means. In accordance with the illustrated embodiments of the invention, the ink applying system incorporates a lower ink distributing roll which is positioned adjacent an upper ink applying roll in horizontally offset relation to define a nip zone for receiving a supply of ink. The rolls are driven in timed relation by a set of gears positioned at corresponding ends of the rolls, and the rolls are supported as a unit for precision adjustment at opposite ends relative to the print cylinder. The lower ink distributing roll is also adjustable relative to the ink applying roll to control precisely the film of ink carried by the ink applying roll to the face of the printing plate.

The ink distributing and applying rolls are positioned within a substantially enclosed ink fountain housing which receives a supply of ink from a recirculating reciprocating plunger-type pump system actuated by the same drive motor which rotates the print cylinder and the ink distributing and applying rolls. In the illustrated embodiments, the recirculating pump system includes a manifold and cap assembly which is adapted to receive a molded plastic ink bottle or container and which also supports a set of concentric ink supply and return tubes depending into the container. The lower end portions of the tubes support a set of corresponding concentrically disposed molded plastic check valve bodies which snap-fit onto the tubes.

In addition to the precision control of the application of the ink of the printing plate, the construction of the ink supplying and applying system provides for dependable service during high speed operation of the printing press. Furthermore, other features and advantages of the invention will be apparent from the following description, the accompanying drawings and the appended claims.

BRIEF DESCRIPTION OF THE DRAWINGS

FIG. 1 is a perspective view of a printing press adapted for printing a continuous supply of labels and which incorporates an ink application system constructed in accordance with the invention;

FIG. 2 is a fragmentary section taken generally on the line 2—2 of FIG. 1;

FIG. 3 is a section taken generally on the line 3—3 of FIg. 2;

FIG. 4 is an end elevational view taken generally on the line 4–4 of FIG. 3 and with a portion broken away;

FIG. 5 is a section taken generally on the line 5—5 of FIG. 3;

FIG. 6 is a section taken generally on the line 6—6 of FIG. 3;

DESCRIPTION OF THE PREFERRED EMBODIMENTS

Figure 7:
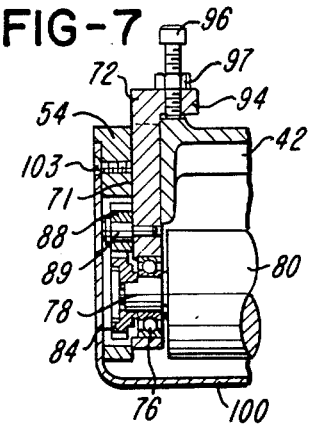
FIG. 7 is a fragmentary section taken generally on the line 7—7 of FIG. 6.

FIG. 1 illustrates a printing press 15 which is adapted to receive a roll 16 of a web or strip S of paper material and to print on the strip S a succession of tags or labels L such as, for example, the labels mentioned above having machine readable coded data or information represented by a series of closely spaced precision lines 18. In general, the printing press 15 includes a housing 20 which supports a cross shaft 21 driven by an electric motor (not shown) enclosed within the housing 20. The strip S is advanced by a feed wheel 22 mounted on the shaft 21, and a type drum or print cylinder 24 (FIG. 2) is positioned forwardly of the feed wheel 22 and is also driven by the motor. The cylinder 24 is adapted to receive a suitable printing plate (not shown) which is attached to the outer surface of the print cylinder, for example, by pressure sensitive adhesive.

An ink fountain assembly or unit 25 is positioned between a set of parallel spaced side wall extensions 26 forming part of the housing 20, generally in front of the feed wheel 22 and the print cylinder 24. As the strip S is repetitively printed to produce the successive labels L, the strip S is directed under the fountain unit 25 and is either rewound into a roll or fed through an optional knife cut-off unit 30 (FIG. 1). The cut-off unit 30 is supported by the housing 20 between the side wall extensions 26 and includes a lower stationary knife member 31 and an upper knife member 32. The upper knife member 32 is reciprocated vertically in response to actuation of an eccentric mechanism within the unit 25. The mechanism is driven by a shaft 34 which extends horizontally from a right angle gear box 36 (FIG. 1) connected to a projecting end portion of the cross shaft 22.

In accordance with the present invention, the ink fountain assembly or unit 25 includes a cover member 42 (FIG. 2) which is secured by a set of screws 43 to a cross support member 44 having an inverted L-shaped configuration. The opposite end portions of the support member 44 are received within correspondingly shaped notches or recesses 47 formed within the side walls of the housing 20, and are secured to the side walls by a set of lock screws 48. Another set of adjusing jack screws 49 extend through threaded holes within opposite end portions of the support member 44 and the ends of the jack screws 49 contact the bottoms of the recesses 47 to provide for precise upward and downward adjustment of the fountain unit 25 when the lock screws 48 are released, as will be explained later.

A set of cast metal end brackets 52 and 54 (FIG. 3) depend from opposite ends of the cover member 42, and the brackets 52 and 54 support a set of aligned antifriction bearings 56 which support the end journals 58 and 59 of an ink applying roll 60. The ink applying roll 60 includes a resilient outer coating or covering 62 (FIG. 2) which has a smooth cylindrical outer surface for applying ink to the printing face of the printing plate mounted on the print cylinder 24. A gear 64 (FIG. 3) is mounted on the journal 58 of the ink applying roll 60 and is driven by a gear (not shown) secured to the corresponding journal of the print cylinder 24. As mentioned above, the print cylinder 24 is driven by an electric motor enclosed within the housing 20.

Another gear 67 (FIGS. 3 and 4) is mounted on the opposite journal 59 of the ink applying roll 60 and is located within a recess 68 formed within the outer surface of the support bracket 54. A set of channel-like grooves or recesses 71 (FIG. 6) are formed within the inner surfaces of the depending support brackets 52 and 54 and slidably support a corresponding pair of support plates 72 (FIG. 6 and 7). Antifriction bearings 76 (FIGS. 5 and 7) are retained by the lower end portions of the support plates 72 and support the end journals 78 (FIGS. 5 and 7) of an ink distributing roll 80 which has a precisionally ground hard outer surface. As best shown in FIG. 6, the support plates 72 are positioned on a slight inclined angle relative to a vertical plane and support the distributing roll 80 in a position below and slighty forward (FIG. 2) of the ink applying roll 60 so that movement of the support plates 72 controls the minute gap of a nip 82 (FIG. 2) formed between the rolls 60 and 80.

A gear 84 (FIGS. 4 and 7) is mounted on one of the end journals 78 of the ink distributing roll 80 within part of the recess or cavity 68 formed within the corresponding support bracket 54, and a set of idle or transfer gears 88 connect the gear 84 to the gear 67 mounted on the journal 59 of the ink applying roll 60. The transfer gears 88 are mounted on corresponding shafts 89 which are supported by the adjacent support plate 72, as shown in FIGS. 4 and 6. Each of the depending support brackets 52 and 54 also supports a resilient rubber-like wiper member 92 (FIG. 6) which engages the corresponding end surfaces of the rolls 60 and 80 adjacent the nip 82 for limiting an axial flow of ink from the nip.

Referring to FIG. 7, each of the support plates 72 includes an inwardly projecting flange 94 which has a threaded hole for receiving an adjusting screw 96 positioned to engage the corresponding top end surface of the cover member 42. Thus each end portion of the ink distributing roll 80 may be precisely adjusted independently relative to the corresponing end portion of the ink applying roll 60 by adjusting the corresponding screw 96 after a lock nut 97 (FIG. 7) is released. As shown in FIGS. 2—7, a generally rectangular pan-like container 100 encloses the ink distributing roll 80 and the end support brackets 52 and 54. The container 100 has an upper edge portion which is secured to the cover member 42 by a series of peripherally spaced screws 103 (FIGS. 2 and 7). The container 100 is provided with a tubular fitting 104 (FIG. 3) which projects from a lower corner of the container and defines an ink return outlet for the container.

As shown in FIG. 2, ink is supplied to the rolls 60 and 80 in the area of the nip 82 through a tubular fitting 110 which projects downwardly and rearwardly to substantially the center of the nip 82. The tubular fitting 110 projects through a hole formed within the center of the cover member 42 and is secured to the cover member by a nut 111. A flexible supply tube 112 connects the fitting 110 to an ink recirculating pump system 115 (FIG. 1) which is supported by a formed sheet metal bracket or cover housing 116 secured to the adjacent side wall of the press 15. The pump system 115 is capable of supplying ink to the tube 112 at a rate greater than the rate at which the ink is applied to the printing plate, and the ink which overflows from the ink distributing roll 80, is collected within the container 100 and returned to the pump system 115 by a flexible ink return tube 117 which has one end connected to the tubular outlet fitting 104.

Figure 9:
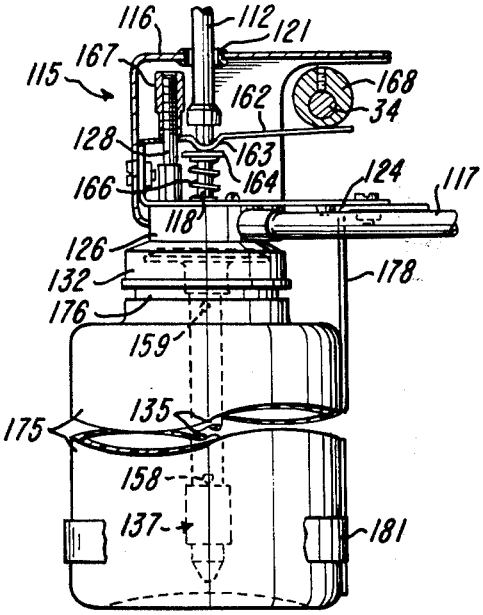
FIG. 9 is an elevational view, in part section, of the ink recirculating pump system shown in FIG. 1, with a portion of the ink supply container broken away.
Figure 10:
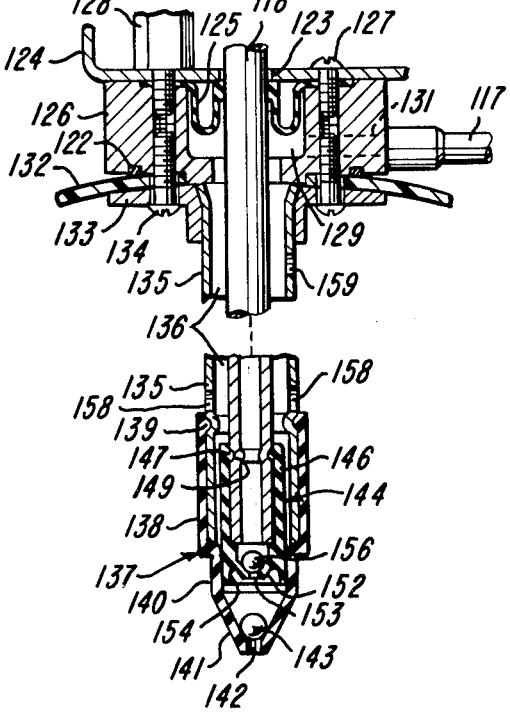
FIG. 10 is an enlarged fragmentary vertical section of the pump mechanism used in the ink recirculating pump system shown in FIGS. 1 and 9.

Referring to FIGS. 9 and 10, the ink recirculating pump system 115 includes a rigid vertical ink supply tube 118 having an upper end portion which receives the opposite end of the ink supply tube 112. The flexible ink supply tube 112 extends through a resilient grommet 121 seated within a hole formed within the upper wall of the housing 116, and the rigid ink supply tube 118 projects downwardly through a hole 123 (FIG, 10) formed within an L-shaped bracket 124 secured to the cover housing 116. A flexible bellows-like diaphragm or seal 125 is mounted on the tube 118 and has an outer peripheral portion clamped to the bracket 124 by an annular manifold 126 secured to the bracket 124 by a set of screws 127 and the threaded lower end portion of a stud 128. The manifold 126 defines a center chamber 129 and has a radially extending passage 131 which connects the chamber 129 with the ink return tube 117. The seal 125 permits the tube 118 to move axially while forming an air-tight closure for the chamber 129.

A circular cap member 132 is secured to the lower portion of the manifold 126 by an annular collar 133 (FIG. 10) and a set of screws 134. An O-ring 122 forms a fluid-tight seal between the cap member 132 and the manifold 126. The collar 133 supports the upper flanged end portion of a vertical outer ink return tube 135 which concentrically surrounds the tube 118 and defines an elongated vertical annular passage 136. A molded plastic check valve housing or body 137 includes an upper cylindrical portion 138 which receives the lower end portion of the outer tube 135 and includes an inner peripheral bead 139 which snap-fits into a circumferential groove formed within the lower end portion of the outer tube 135. The check valve body 137 also includes a reduced cylindrical intermediate portion 140 which integrally connects the upper cylindrical portion 138 to a tapered or frustoconical lower end portion 141 defining an inlet or opening 142. A spherical valve member or ball 143 normally seats within the lower end portion 141 of the body 137 for normally closing the inlet 142.

A piston member 144 is also formed of a molded plastics material and includes a cylindrical upper portion 146 which receives the lower end portion of the tube 118. The cylindrical portion 146 has an internal peripheral bead 147 which snap-fits into a circumferential groove 149 formed within the lower end portion of the tube 118. The piston member 144 also includes a lower frusto-conical end portion 152 having a center opening 153 and is surrounded by an annular skirt portion 154. The skirt portion 154 fits closely within the cylindrical portion 140 of the housing 137 for sliding reciprocation movement. Another spherical valve member or ball 156 normally seats on the inner surface of the frusto-conical portion 152 of the piston member 144, normally closing the opening 153. A set of holes 158 (FIG. 10) are formed within the lower end portion of the outer tube 135, and vent hole or opening 159 is formed within the upper end portion of the tube 135.

Referring to FIG. 9, an actuating member or lever 162 includes a clearance hole for receiving the upper end portion of the tube 118. The lever 162 has a downwardly projecting curved portion 163 which seats on a retaining ring 164 secured to the tube 118. A compression spring 166 surrounds the tube 118 and abuts the retaining ring 164 and the bracket 124. The inner end portion of the actuating lever member 162 has a hole for receiving the upper externally threaded end portion of the stud 128, and a tubular nut 167 is adjustably mounted on the stud 128 to form a fulcrum for the lever member 162.

As illustrated in FIG. 1, the shaft 34 extends through or under the cover housing 116, and a cylindrical cam member 168 is eccentrically mounted on the shaft 34 above the actuating lever 162. Thus rotation of the cam member 168 is effective to pivot the lever 162 and reciprocate the inner tube 118 and piston member 144 within the surrounding corresponding outer tube 135 and valve body 137. The concentric tubes 118 and 135 project downwardly or depend into a generally cylindrical bottle or container 175 which holds a supply of ink. Preferably, the container 175 is molded of a plastics material and has an integral upper neck portion 176 which threads into the cap member 132 secured to the manifold 126. The container 175 is also supported by an inverted L-shaped support strap 178 having an upper leg portion secured to the bracket 124 and a lower end portion clamped to the container 175 by an adjustable hose-type band clamp 181.

The ink supply system described above, operates in the following manner. A supply of ink is pumped to the fountain assembly or unit 25 through the tube 112 in response to the continuous rotation of the shaft 34 and cam member 168 (FIG. 9) which reciprocates the tube 118 within the tube 135 by a preselected amplitude as determined by the adjustment of the tubular nut 167. The reciprocation of the piston member 144 within the valve body 137 produces a continuous pulsating flow of ink from the container 175 through the openings 142 and 153 and upwardly through the ink supply tube 118.

As the ink is supplied through the tube 112 (FIG. 2), it forms a pool of ink ahead of the nip 82 and along the length of the rolls 60 and 80. A film of ink is carried through the nip 82 by the roll 60 and is applied to the face of the printing plate secured to the print cylinder 24. The ink which flows over the ink distributing roll 80 collects within the container 100 and is directed back to the recirculating pump system 115 through the tube 117. The return ink flows downwardly through the annular passage 136 and out through te openings 158 within the lower end portion of the tube 135. The vent opening 159 enables air to enter the container 175 above the ink supply and thereby prevent a partial vacuum for forming within the container 175.

As mentioned above in connection with FIGS. 2–7, the application of the ink onto the printing plate by the roll 60 may be precisely controlled by selectively adjusting the screws 49 and 96 for the opposite end portions of the rolls 60 and 80. That is, by precisely adjusting each screw 49, the corresponding end portion of the entire fountain assembly or unit 25 is adjusted generally vertically to control the pressure exerted by the roll 60 on the face of the printing plate and to obtain a uniform application pressure. In addition, each end portion of the ink distributing roll 80 may be precisely and independently positioned by adjusting the corresponding screw 96. This adjustment feature provides for precisely positioning the ink distributing roll 80 relative to the ink applying roll 60 to control the film of ink carried by the roll 60 through the nip 82 and to assure that the film is precisely uniform along the entire length of the rolls 60 and 80. As best illustrated in FIGS. 4 and 6, the slightly inclined adjustable support plates 72 are positioned so that the transfer gear 88 engaging the gear 67, moves in a direction substantially tangential to the gear 67 when the corresponding plate 72 is adjusted by the screw 96. Thus the drive engagement between the gears is not effected by adjustment of the corresponding end portion of the roll 80 relative to the roll 60.

Figure 8:
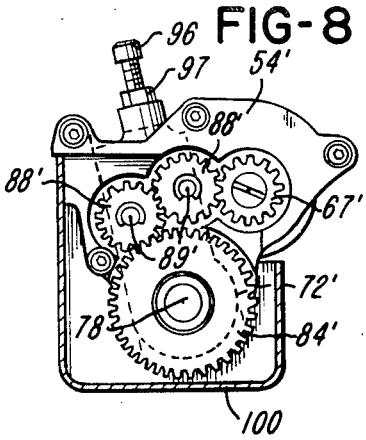
FIG. 8 is a view similar to FIG. 4 and showing a modification of the invention.

Referring to the modification shown in FIG. 8, in some ink application systems, it is desirable for the ink distributing roll 80 to rotate at a speed substantially slower than the speed of the ink applying roll 60. To obtain this differential speed between the rolls 60 and 80, a gear 67' is mounted on the journal 59 of the roll 60, and a substantially larger diameter gear 84' is mounted on the corresponding journal 78 of the roll 80. A set of transfer gears 88' are supported by shafts 89' and connect the gear 67' to the gear 84' to provide the lower speed rotation of the distributing roll 80 relative to the ink applying roll 60. In a manner similar to that described above in connection with FIG. 4, the gear 84' and transfer gear 88' are supported by the adjacent plate 72' for linear adjustment within the channel 71 formed within the bracket 54'. The opposite end portions of the roll 60 and 80 are supported in the same manner as described above in connection with the embodiment as shown in FIGS. 2–7.

As illustrated in the drawings and described above, the ink applying roll 60 is precisely positioned to apply a uniform coating of ink to a printing plate mounted on the print cylinder 24. However, it is to be understood that the roll 60 may also be used for applying ink to an intermediate ink transfer roll or roller such as, for example, the traveling inking roller shown in above mentioned U.S. Pat. No. 3,742,851. Furthermore, while the forms of ink supplying and applying apparatus herein described constitute preferred embodiments of the invention, it is to be understood that the invention is not limited to these precise forms of apparatus, and that changes may be made therein, without departing from the scope and spirit of the invention as defined in the appended claims.

The invention having thus been described, the following is claimed:

1. An improved system for supplying ink from an ink supply container to an ink fountain of a printing press, said system comprising a pump including an elongated inner tube supported for reciprocating movement within an elongated outer tube, said inner tube defining a first fluid passage and said outer tube cooperating with said inner tube to define a second fluid passage therebetween, means for supporting said tubes within said container and defining a third fluid passage connected to said second passage, means defining an opening for connecting said second fluid passage with said ink supply container, a first conduit connecting said first passage to said ink fountain and providing for reciprocating movement of said inner tube, a second conduit connecting said third passage to said ink fountain, a set of corresponding check valves connected to the lower end portions of said tubes, means for reciprocating said inner tube within said outer tube to effect pumping of ink from said container through said first passage and said first conduit to said ink fountain, and said second conduit cooperates with said second and third passage to return excess ink from said ink fountain to said ink supply container.

2. A system as defined in claim 1 wherein said means for supporting said tubes comprise a manifold a cap member connected to said manifold, and said container is releasably connected to said cap member for supporting the ink supply.

3. A system as defined in claim 1 wherein at least one of said tubes has a recess within its outer surface, and the corresponding said check valve includes a valve body of molded material and having a portion which snap-fits into said recess.

4. A system as defined in claim 1 including a knife cutting unit adapted to cut a continuous strip of articles being printed by the printing press, and said means for producing said reciprocating movement of said inner tube comprise a drive mechanism which is also connected to drive said knife cutting unit.

5. An improved system adapted for supplying ink fluid to a printing press, comprising a set of inner and outer elongated tubes adapted to depend into a supply container of the fluid, means supporting said tubes for relative reciprocating longitudinal movement, a set of check valves mounted on corresponding lower end portion of said tubes, each of sid tubes including a peripheral recess within its outer surface, each of said check valves including a valve body of molded deformable material and having an integral securing portion which receives the lower end portion of the corresponding said tube, said securing portion of each valve body includes an inwardly projecting protrusion which snap-fits into the corresponding said recess to provide for rapid and convenient assembly of said valve bodies on said tubes and to facilitate periodic removal of said valves for cleaning, and means for producing relative reciprocating movement of said tubes for pumping the fluid upwardly through said inner tube.

6. A system as defined in claim 5 wherein said inner and outer tubes define a longitudinally extending passage therebetween, and means for directing fluid into said passage.

7. A system as defined in claim 5 wherein the lower end portion of each said tube has a peripherally extending groove, and said securing portion of each said valve body is generally cylindrical and has an inwardly projecting circumferential bead seated within said groove.

* * * * *